US005394855A

United States Patent [19]

Richards

[11] Patent Number: 5,394,855

[45] Date of Patent: Mar. 7, 1995

[54] MULTIPLE APPLIED SPARK IGNITION

[76] Inventor: Jonathan F. Richards, 2451 38th Ave. North, St. Petersburg, Fla. 33713

[21] Appl. No.: 161,591

[22] Filed: Dec. 6, 1993

[51] Int. Cl.[6] ..... F02P 3/06

[52] U.S. Cl. ..... 123/648

[58] Field of Search ..... 123/648, 168 CC, 602, 123/594; 315/209 T, 209 SC

[56] References Cited

U.S. PATENT DOCUMENTS

| | | | |
|---|---|---|---|
| 3,437,876 | 4/1969 | Dotto | 123/648 |
| 3,516,396 | 6/1970 | Lawson, Jr. | 123/648 |
| 4,169,446 | 10/1979 | Jackson et al. | 123/148 CC |
| 4,380,224 | 4/1983 | Van Siclen, Jr. | 123/602 |
| 4,710,681 | 12/1987 | Zikovich | 315/209 T |

*Primary Examiner*—Raymond A. Nelli
*Attorney, Agent, or Firm*—Harold D. Shall

[57] ABSTRACT

An ignition system for an internal combustion engine which includes a distributor and electronic control unit, a plurality of ignition coils, a like plurality of silicone controlled rectifiers for each spark plug, and with each spark plug having a like plurality of conductors therein. The distributor puts out a signal to the rectifiers of the spark plug which is about to fire and turns the rectifiers on. The distributor also puts out a signal to the control unit which in turn supplies a triggering signal to the ignition coils causing them to discharge through the rectifiers which have been turned on and through the latter to the conductors in the spark plug.

5 Claims, 2 Drawing Sheets

MULTIPLE APPLIED SPARK IGNITION

BACKGROUND OF THE INVENTION

1. Field of the Invention

This invention relates to ignition systems for internal combustion engines generally and more particularly to such an ignition system which provides a plurality of sparks to each combustion chamber from a single spark plug per chamber.

2. Description of Prior Art

The devices of U.S. Pat. Nos. 2,904,610; 3,842,819; 4,004,562 and 4,436,068 are adapted to provide multiple sparks to a combustion chamber, however, none of them use semiconductors to get a plurality of ignition coils to provide a like plurality of sparks through a like plurality of conductors to each spark plug, with each spark plug having a like plurality of conductors.

SUMMARY OF THE INVENTION

The present invention is an ignition system for an internal combustion engine which includes a distributor, an electronic ignition control unit, a plurality of ignition coils, a like plurality of silicone controlled rectifiers for each spark plug, and one or more spark plugs, with each having a like plurality of conductors therein. The distributor puts out a control signal to the silicone controlled rectifiers (SCR) of the spark plug which is about to fire and turns the SCR's "on". The distributor also puts out a triggering signal to the electronic ignition control unit which in turn supplies a triggering signal to the ignition coils causing them to discharge through the SCR's which have been turns on and from the latter to the conductors of the spark plug.

DETAILED DESCRIPTION OF THE PREFERRED EMBODIMENT

Figure 1:
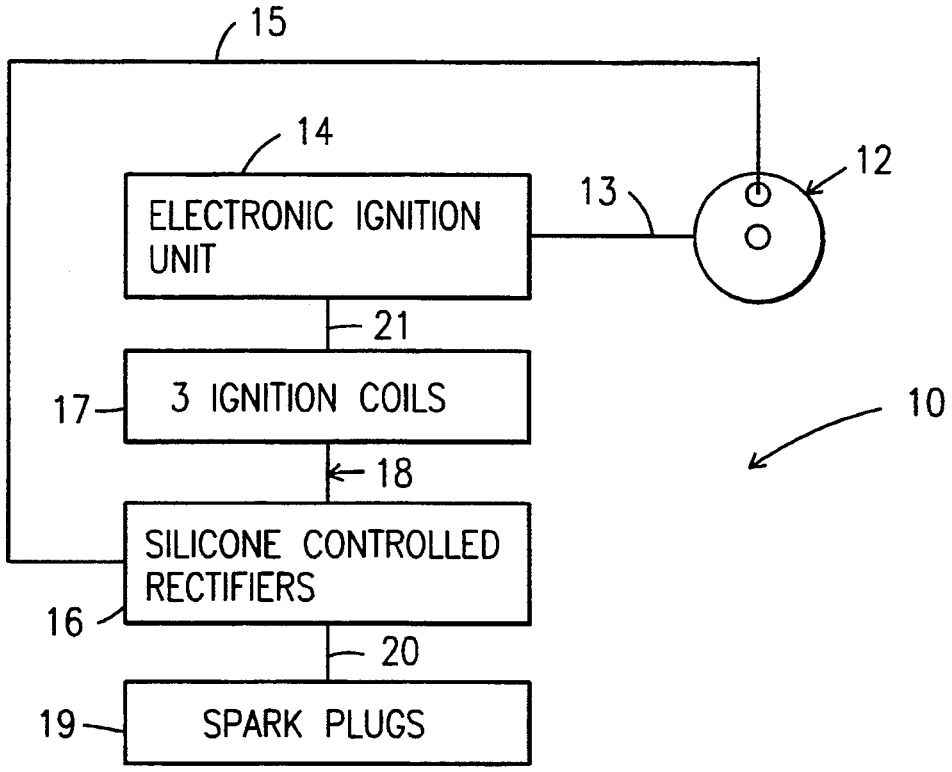
FIG. 1 is a block diagram of the ignition system of this invention.

Referring now to the drawings and more particularly FIG. 1, an ignition system 10 is shown which includes a distributor 12 which puts out two signals, a first signal through a conductor 13 to an electronic control unit 14 and a second signal through one of a plurality of conductors 15 to a selected three semiconductors in the form of silicone controlled rectifiers (SCR's) shown generally at 16 in FIG. 1. The signal to the SCR's turn the same "on" so that current from three ignition coils, shown generally at 17 in FIG. 1, through three conductors, shown generally at 18 in FIG. 1, can flow through the selected SCR's to the associated spark plug 19 through the wire 20, which has three conductors therein. The ignition coils 17, are conventionally triggered by the electronic ignition control unit 14 through three conductors, shown generally at 21 in FIG. 1 and discharge a current through conductors 18 to the SCR's 16.

Figure 2:
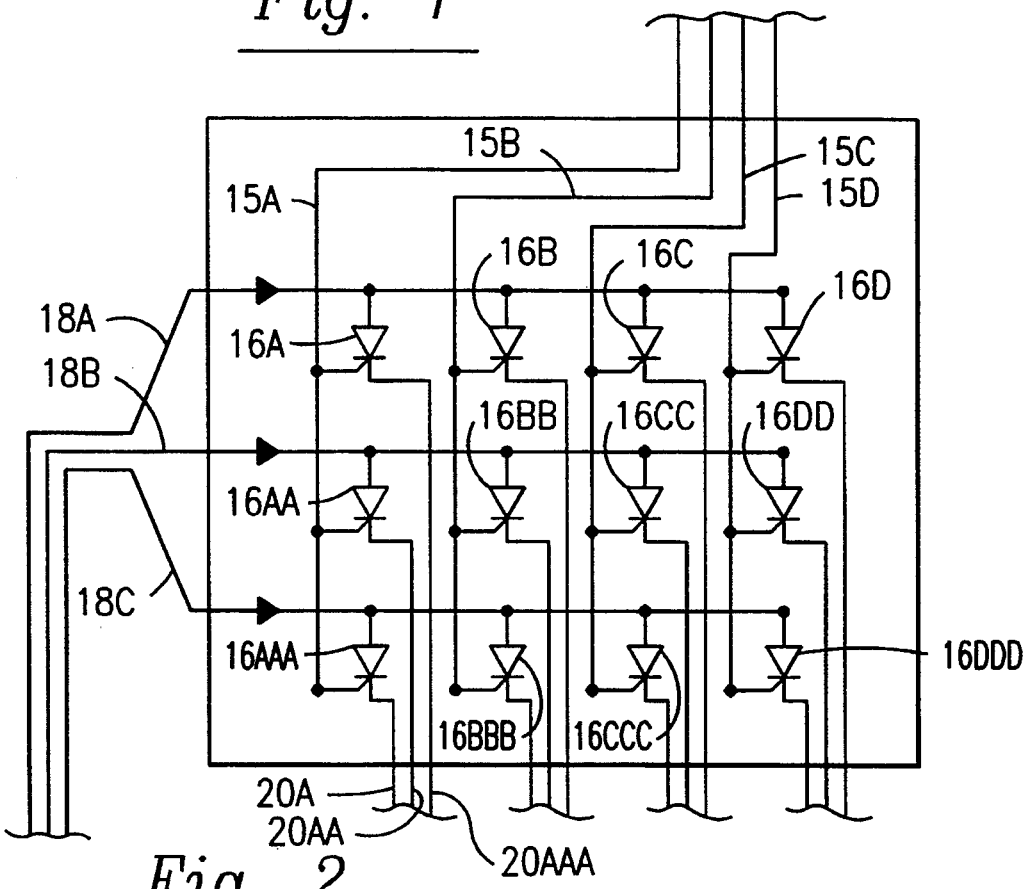
FIG. 2 is a schematic diagram of the wiring associated with the SCR's of this invention.
Figure 4:
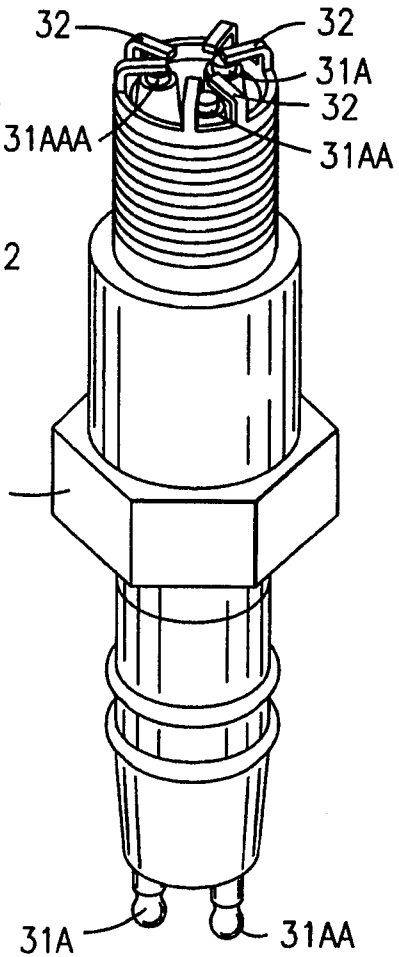
FIG. 4 is a perspective view of a spark plug for use with this invention.
Figure 6:
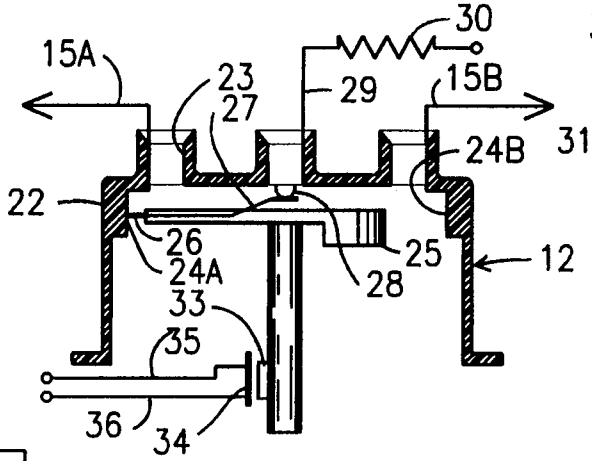
FIG. 6 is a diagiamatic view of a distributor for use with this invention.
Figure 5:
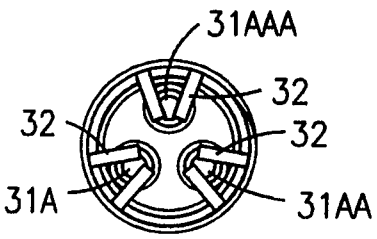
FIG. 5 is an end view of the spark plug of FIG. 4.

Referring now to FIG. 6, a distributor which has been found suitable for this invention is shown generally at 12 and includes a two piece housing 22 having a plurality of conductor receiving openings 23 in the top thereof, one for each spark plug, with the openings receiving the conductors 15 as shown at 15A and 15B. The conductors 15 connect to the associated distributor point, as shown at 24A and 24B, which points are contacted by the rotor 25 of the distributor as the latter rotates. The distributor shown at 12 can be a conventional electronic Chrysler distributor modified so that the tip 26 of the rotor 25 actually touches the distributor points as it rotates to thereby conductively pass a current from the rotor to the points. A spring contact 27 on the rotor 25 engages a contact point 28 which, in turn is conductively connected to a distributor wire 29, which has a ballast resistor 30 therein, with the wire 29 ultimately connecting to the vehicle battery, not shown in FIG. 6. The resistor 30 is a one watt, 6200 ohm resistor available from Mouser Electronics of Randolf, N.J. under part number 261-6.2K and is chosen to provide about a 5 volt current through the conductor 29 and out of the distributor to the various conductors 15. As seen in FIG. 2, the various conductor 15, namely 15A, 15B, 15C and 15D (the system 10 shown here is for a four cylinder engine having four spark plugs) each extend to the gate of three SCR's, e.g., conduct 15A to the gate of SCR's 16A, 16AA and 16AAA; Conductor 15B to the gate of SCR's 16B, 16BB and 16BBB; Conductor 15C to the gate of SCR's 16C, 16CC and 16CCC; and Conductor 15D to the gate of SCR's 16D, 16DD and 16DDD. When current flows through the selected conductor 15A, 15B, 15C or 15D to the SCR, the SCR is turned "on" and current can then flow from the anode of the SCR through the SCR to the cathode thereof. When the current stops flowing through the conductor 15, the associated SCR are turned "off" and current stops flowing therethrough. SCR's suitable for use in this invention may be obtained from Mouser Electronics of Randolf, N.J. under Mouser part #519-2N-5064 and are 0.8 amp and 200 volt SCR's.

The anodes of the SCR's 16A, 16B, 16C and 16D are connected by the conductor 18A to the ignition coil 17A; the anodes of SCR's 16AA, 16BB, 16CC and 16DD are connected by the conductor 18B to the ignition coil 17A and the anodes of the SCR's 16AAA, 16BBB, 16CCC and 16DDD are connected by the conductor 18C to the ignition coil 17C. The cathodes of the SCR's 16A, 16AA and 16AAA are connected, respectively by a conductor 20A, 20AA and 20AAA to the three conductors 31A, 31AA and 31AAA of the spark plug 19A. Associated within the spark plug 19A are two ground tangs 32 for each conductor so that when current is applied to the conductor a spark will appear between the conductor and associated ground tangs.

The distributor 12 also supplies a signal to the electronic ignition control unit 14 and in response to such signal the control unit actuates the coils 17A, 17B and 17C in a conventional manner so that the coils supply a timed current to the anode of the SCR's. Referring to FIG. 6, the distributor 12 includes a reluctor 33 which has a high spot (not shown) corresponding to each cylinder of the engine. A pick up coil 34 is disposed adjacent the reluctor 33 and each time a high spot of the reductor passes the coil a timing signal is given to the electronic control unit 14 through the conductors 35 and 36. In response to the timing signal, the control unit 14 activates the coils 17A, 17B and 17C, respectively, through the conductors 21A, 21B and 21C so that the coils discharge a current through the conductors 18A, 18B and 18C and ultimately to the spark plugs 19. The reluctor 33 and the associated pick up coil 34 can be located elsewhere, for example in relation to the engine crankshaft, as long as the signal given thereby is a reliable indicator of the engines operation.

An electronic ignition control unit suitable for this invention is a Chrysler control unit part number P4120505 while the ignition coils are also obtainable as Chrysler coils part number P369056D.

Figure 3:
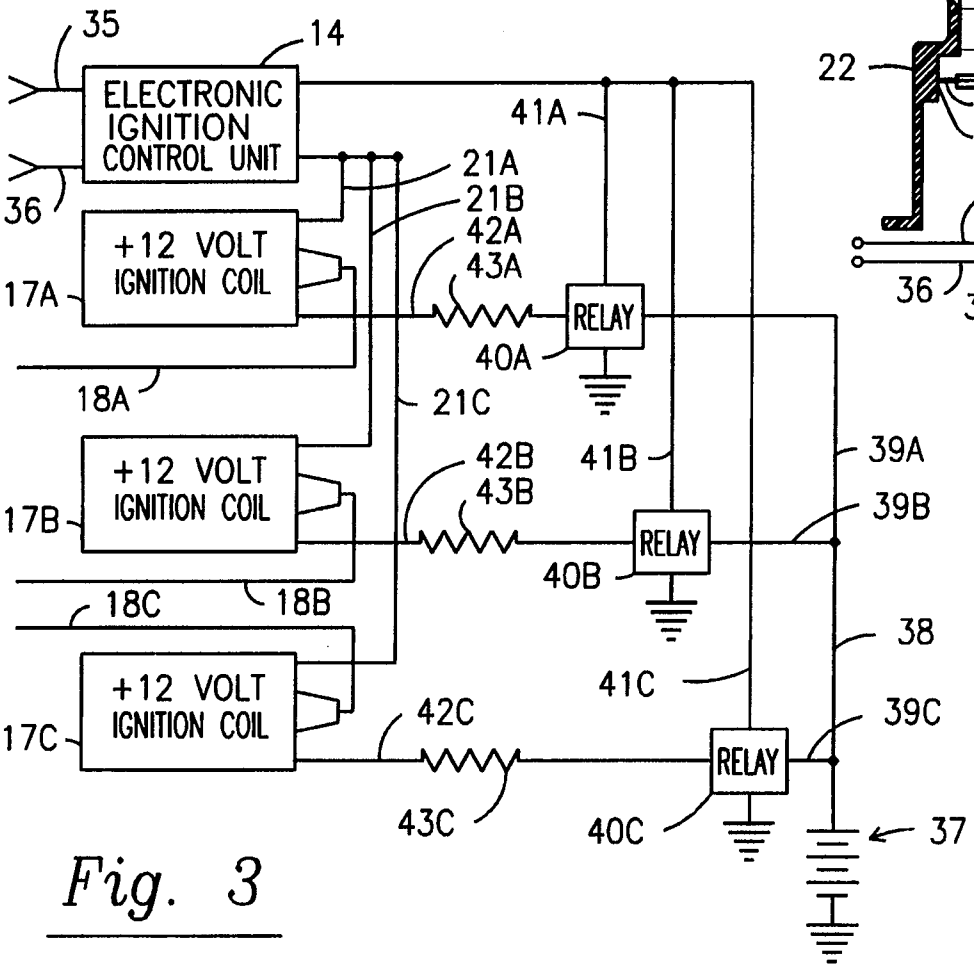
FIG. 3 is a block diagram of the electronic ignition control unit, the ignition coils and the associated wiring of this invention.

Referring now to FIG. 3, a battery 37 associated with the ignition system 10 is connected at its positive terminal to a conductor 38 which in turn is connected to three conductors 39A, 39B and 39C. Conductor 39A is connected to a relay 40A which in turn is connected to ground and also connected to the positive terminal of the control unit 14 by a conductor 41A and by a conductor 42A to the positive terminal of the coil 17A; the conductor 42A having a ballast resistor 43A therein. The ballast resistor 43A can be in the general range of 0.5 to 1.2 ohms while the one selected is a 1 ohm resistor Chrysler part number P5206436. The relay is obtainable from Radio Shack under part number 275-266. The relay reduces the current demand from the control unit and provides the higher current required for the coils. The internal resistance of the coil along with the ballast resistor are used to limit the total current. Conductor 39B is connected to a relay 40B which, in turn, is connected to ground and also is connected to the positive terminal of the control unit 14 by a conductor 41B and by a conductor 42B to the positive terminal of the coil 17B; the conductor 42B having a ballast resistor 43B therein. The conductor 39C is connected to a relay 40C which, in turn, is connected to ground and also is connected to the positive terminal of the control unit 14 by a conductor 41C and by a conductor 42C to the positive terminal of the coil 17B; the conductor 42C having a ballast resistor 43C therein.

While the system shown is for a four cylinder engine, it can easily be adapted to any internal combustion engine with one or more cylinders. Further, while the system shown is for a spark plug with three conductors, it can easily be modified for any system having two or more conductors per spark plug as long as there is room for the conductors in the spark plug.

Although the above description relates to a presently preferred embodiment, numerous changes can be made therein without departing from the scope of this invention as claimed in the following claims.

What is claimed is:

1. An multiple applied spark ignition system for an internal combustion engine having one or more cylinders comprising in combination, a. A spark plug for each of the cylinders of the engine with said spark plug having a plurality of conductors therein, b. distributor means for supplying a current at such time as said spark plug is ready to be sparked, c. a semiconductor means connected to each conductor in said spark plug, d. said semiconductor means having a current passing and a current blocking condition and a gate terminal which when energized places said semiconductor means in current passing condition and when de-energized places said latter means in a current blocking condition, e. said distributor means being connected to said semiconductor means for energizing and de-energizing said gate terminals of all said semiconductor means connected to the conductors in said spark plug, f. an ignition coil for each conductor in said spark plug with said coil being conductively connected to said semiconductor means, g. said semiconductor means being conductively connected to said spark plug whereby when said semiconductor means is energized by said distributor means said ignition coil is conductively connected to said spark plug and when said semiconductor means is de-energized said ignition coil is not conductively connected to said spark plug means, h. an electronic ignition control unit for activating each of said ignition coils to discharge to said spark plug a charge of high voltage current, and i. signal means responsive to the condition of the internal combustion engine for providing a signal to said electronic ignition control unit for causing the latter to alternately activate and deactivate said ignition coils.

2. A system according to claim 1 wherein each of said semiconductors is a silicone controlled rectifier having a gate, an anode and a cathode, means connecting said gate to said distributor, means connecting said anode to one of said coils, and means connecting said cathode to one of the conductors of said spark plug.

3. A system according to claim 2 wherein connecting means connects said distributor to a twelve volt battery and said connecting means includes a ballast resistor to reduce the voltage to said distributor to approximately five volts.

4. A system according to claim 1 wherein said signal means is disposed within said distributor.

5. A system according to claim 2 wherein said signal means is disposed within said distributor.

* * * * *